US011285526B2

(12) United States Patent
Erhard

(10) Patent No.: US 11,285,526 B2
(45) Date of Patent: Mar. 29, 2022

(54) MULTISTAGE PRESS AND METHOD FOR PRODUCING A FORMED PART

(71) Applicant: NEDSCHROEF HERENTALS N.V., Herentals (BE)

(72) Inventor: Justus Erhard, Homberg/Ohm (DE)

(73) Assignee: Nedschroef Herentals N.V., Herentals (BE)

( * ) Notice: Subject to any disclaimer, the term of this patent is extended or adjusted under 35 U.S.C. 154(b) by 0 days.

(21) Appl. No.: 16/767,709

(22) PCT Filed: Dec. 12, 2017

(86) PCT No.: PCT/EP2017/082318

§ 371 (c)(1),
(2) Date: May 28, 2020

(87) PCT Pub. No.: WO2019/114929

PCT Pub. Date: Jun. 20, 2019

(65) Prior Publication Data

US 2020/0298301 A1 Sep. 24, 2020

(51) Int. Cl.
*B21K 1/56* (2006.01)
*B21F 23/00* (2006.01)
(Continued)

(52) U.S. Cl.
CPC ..... *B21K 1/56* (2013.01); *B21F 23/005* (2013.01); *B21K 27/04* (2013.01); *B21F 5/005* (2013.01);
(Continued)

(58) Field of Classification Search
CPC .. B21J 1/06; B21J 9/022; B21K 29/00; B21K 27/04; B21K 27/06; B21K 1/56;
(Continued)

(56) References Cited

U.S. PATENT DOCUMENTS 2,276,521 A * 3/1942 Stark ..... B21J 1/06 219/602
4,100,829 A * 7/1978 Stangl ..... B21K 27/06 83/106
(Continued)

FOREIGN PATENT DOCUMENTS

CH 346749 A 5/1960
DE 19537541 A1 * 4/1996 ..... B21J 9/02
(Continued)

OTHER PUBLICATIONS

English translation of the International Preliminary Report on Patentability in PCT/EP2017/082318, dated Jun. 18, 2020.
(Continued)

*Primary Examiner* — Adam J Eiseman
*Assistant Examiner* — Katie L. Parr
(74) *Attorney, Agent, or Firm* — Collard & Roe, P.C.

(57) ABSTRACT

A multistage press for the bulk deformation of a piece of wire includes a wire feed with associated apparatus for cutting to length, and a transfer device—having grippers—for receiving a piece of wire that has been cut to length and transferring the latter to subsequent forming stages, there being arranged, on that side of the cutting-to-length apparatus opposite from the wire feed, a device for partially heating a length of wire. A method produces a formed part with a multistage press of this type.

7 Claims, 2 Drawing Sheets

(51) Int. Cl.

| | |
|---|---|
| ***B21K 27/04*** | (2006.01) |
| ***B21J 1/06*** | (2006.01) |
| ***B21K 29/00*** | (2006.01) |
| ***B21F 11/00*** | (2006.01) |
| ***B21K 27/06*** | (2006.01) |
| ***B21F 5/00*** | (2006.01) |

(52) U.S. Cl.
CPC ..... *B21F 11/00* (2013.01); *B21J 1/06* (2013.01); *B21K 27/06* (2013.01); *B21K 29/00* (2013.01)

(58) Field of Classification Search
CPC ..... B21F 23/005; B21F 11/00; B21F 5/005; B21D 43/285
See application file for complete search history.

(56) References Cited

U.S. PATENT DOCUMENTS

| | | | | |
|---|---|---|---|---|
| 4,404,830 | A * | 9/1983 | Koch | B21J 1/06 226/156 |
| 7,347,075 | B2 | 3/2008 | Vescovini | |
| 8,382,601 | B2 | 2/2013 | Gensert | |
| 11,072,021 | B2 * | 7/2021 | Riemeier | B25J 9/1692 |
| 2012/0277007 | A1 * | 11/2012 | Oishi | B21J 1/06 470/10 |
| 2013/0255823 | A1 * | 10/2013 | Brottlund | B21B 1/166 140/139 |

FOREIGN PATENT DOCUMENTS

| | | | | |
|---|---|---|---|---|
| EP | 0 215 338 | A1 | 3/1987 | |
| EP | 3215338 | A1 | 3/1987 | |
| EP | 2 156 909 | A2 | 2/2010 | |
| GB | 707092 | A | 4/1954 | |
| JP | S62-259634 | A | 11/1987 | |
| JP | 2005193252 | A | 7/2005 | |
| JP | 3793953 | B2 * | 7/2006 | B21J 17/02 |
| JP | 3793953 | B2 | 7/2006 | |
| RU | 2 323 061 | C2 | 4/2008 | |
| SU | 1708485 | A1 | 1/1992 | |
| WO | WO-9710065 | A1 * | 3/1997 | B22D 17/30 |

OTHER PUBLICATIONS

International Search Report in PCT/EP2017/082318, dated Sep. 18, 2018.

* cited by examiner a)

b)

c)

d)

MULTISTAGE PRESS AND METHOD FOR PRODUCING A FORMED PART

CROSS REFERENCE TO RELATED APPLICATIONS

This application is the National Stage of PCT/EP2017/082318 filed on Dec. 12, 2017, the disclosure of which is incorporated by reference. The international application under PCT article 21(2) was not published in English.

BACKGROUND OF THE INVENTION

1. Field of the Invention

The invention relates to a multi-stage press for solid forming of a wire section. The invention furthermore relates to a method for the production of a formed part, in particular of a screw, using a multi-stage press.

2. Description of the Related Art

Multi-stage presses for cold forming of wire are known in various embodiments, for example from EP 0 215 338 A1. In this regard, a straightened wire is guided from the coil into the machine, where a defined wire section is cut to length. The wire section is conveyed, by way of a gripper of a transfer apparatus, to a first forming stage formed by a die and a punch, where the section is positioned in a holder of the punch. Subsequently, the wire section is pushed into the die by way of the punch and deformed. After forming, the formed wire piece is positioned in a further gripper of the transport apparatus by means of an ejector pin, and transported to the next forming stage, in each instance, by way of this gripper. In this regard, the punches of the forming tools, which are arranged one behind the other, are regularly arranged on a common horizontal cylinder, so that deformation of a wire section takes place in each of the forming stages, per advancement of this cylinder.

The wire section is formed to produce the finished workpiece by way of the forming stages, which are arranged one behind the other. In the last forming stage, the finished part is ejected. Common multi-stage presses have six forming stages.

Different cold-formed parts such as screws or bolts can be produced by means of multi-stage presses of the aforementioned type. A high process speed can be achieved by way of the forming stages, which are arranged one behind the other, since six wire sections can be formed at every advancement of the cylinder. However, forming becomes problematical in the case of special materials, such as heat-resistant nickel-based alloys, for example (for example NI 53/FE19/CR19/NB/MO/TI). For the production of screws made of this material, it is necessary to heat the region of the screw head up to as much as 1000° C. before its forming. In this regard, it must be taken into consideration that the screw shaft must remain cold, since otherwise quality losses of the thread to be introduced into the screw shaft subsequently would be the result. For the production of such special screws, blanks are first produced from wire sections, in the case of which blanks an end section is formed to produce a screw head, with prior heating. These blanks are subsequently fed to a multi-stage press piece by piece for production of the desired screw.

A disadvantage of the previously known production methods of such special screws is that this is very complicated. Furthermore, individual switching of screw length or dimension is only possible with great effort, since corresponding blanks first have to be produced for this purpose.

SUMMARY OF THE INVENTION

This is where the invention seeks to provide a remedy. The invention is based on the task of making available a multi-stage press for solid forming of a wire section, which press also allows the production of special screws of the aforementioned type, directly from the wire coil. This task is accomplished by means of a multi-stage press having the characteristics according to the invention.

With the invention, a multi-stage press for solid forming of a wire section is made available, which press also allows the production of special screws of the aforementioned type, directly from a wire composed of a heat-resistant nickel alloy. Because of the fact that means for partial heating of a wire section are arranged on the side of the apparatus for cutting to length that lies opposite the wire feed, heating of a defined end-side wire section for subsequent forming of the screw head is made possible, wherein after heating of the end-side wire section, the wire can be cut to a desired length before it is transported to a first forming stage by way of the transfer device. Because of the fact that the wire feed, the forming stages (i.e. the cylinder that drives the punches of the forming stages) and the apparatus for cutting to length can be controlled independently of one another, prompt forming of a wire section that has been heated on its end side and subsequently cut to length, over all the forming stages, with simultaneous heating of the next end section, is made possible.

In a further development of the invention, the means for heating a wire section comprise an induction coil, wherein the wire feed is set up for temporary introduction of a wire section into the induction coil. As a result, setting of a defined temperature of an end-side wire section is made possible. The temperature of the wire section results from the power emitted by the induction coil as well as the dwell time of the wire section in the induction coil.

In an embodiment of the invention, the wire feed comprises a servo-drive for defined forward and backward movement of a wire section. As a result, precise feed of the wire from the coil, as needed, is made possible. Because of the possibility of defined forward and backward movement of the wire, introduction of the wire end into the induction coil as well as a subsequent backward movement of the wire to determine the wire section to be cut to length is made possible.

In a further embodiment of the invention, the wire feed can be controlled by way of a controller connected with it, in which controller a defined dwell time of a wire section in the induction coil and/or a target temperature can be stored. In this regard, means for detection of the temperature of a wire section situated in the induction coil are preferably provided, which means are connected with the controller, wherein a regulator is integrated into the controller, by means of which regulator the wire feed can be controlled as a function of the temperature of the wire section. Alternatively, empirical determination of dwell times to achieve desired temperatures is also possible, which dwell times are stored in the controller.

In a further development of the invention, the controller is connected with the apparatus for cutting to length, and set up in such a manner that after partial heating at the end side of a wire section has taken place, this section is cut to a defined length. As a result, the length of the screws to be produced, in each instance, can be individually adjusted.

The present invention is furthermore based on the task of making available a method for the production of a special screw of the aforementioned type, using a multi-stage press, directly from the coil. This task is accomplished by means of a method having the characteristics according to the invention. Because of the fact that a wire is first heated on the end side, subsequently a wire section is cut to length at a defined distance from the heated end, and the partially heated wire section achieved in this way is fed to multiple forming stages, one after the other, by way of a transfer device, individual adjustment of the length of the screw produced is made possible. In this regard, the wire is preferably fed from a coil, by way of a wire feed, to an induction coil, where it is heated to a defined temperature on the end side.

In a further development of the invention, the wire is fed to the induction coil by way of a servo-drive, wherein the wire is moved into the induction coil in accordance with the desired length of the end-side region that is to be heated, and after the desired temperature has been reached or after the dwell time required for this purpose it is moved out of the induction coil again, and afterward a wire section having the desired length is cut off. As a result, precise process management for the production of screws having different lengths, from a coil, is made possible.

In an embodiment of the invention, measurement of the temperature of the end-side region of the wire takes place by way of a contact-free temperature sensor, in particular a pyrometer or also by way of an infrared measurement device. In this way, the precision of process management is further improved. Alternatively, the required dwell time for achieving the desired temperature within the induction coil can also be determined empirically and stored in a controller connected with the servo-drive. In this manner, it is also conceivable to create a database with dwell times assigned to corresponding target temperatures, in the manner of an expert system.

BRIEF DESCRIPTION OF THE DRAWINGS

Other further developments and embodiments of the invention are discussed below. An exemplary embodiment of the invention is shown in the drawings and will be described in detail below. The figures show.

a) advancing the wire from the coil;
b) heating the end-side wire section in the induction coil;
c) moving the wire backward, with setting of the desired length, and
d) cutting the wire section to the desired length, along with take-over by the transfer device.

DETAILED DESCRIPTION OF THE PREFERRED EMBODIMENTS

The horizontal multi-stage press 1 selected as the exemplary embodiment is a multi-stage press with a horizontal design, as it is used for the production of screws and similar small parts. The structure of such horizontal multi-stage presses is sufficiently known to a person skilled in the art and is described in EP 0 215 338 A1, for example. In this regard, the forming tools are arranged next to one another. A transverse transfer device brings the workpieces from one forming stage to the next forming stage. Usually, these presses operate with a transverse transport carriage, which has a number of transfer grippers that corresponds to the number of forming stages, which grippers project between the punch tools and the dies. For this reason, a detailed description of such a horizontal multi-stage press will not be given here. The description below focuses on the essential components of the multi-stage press according to the invention.

Figure 1:
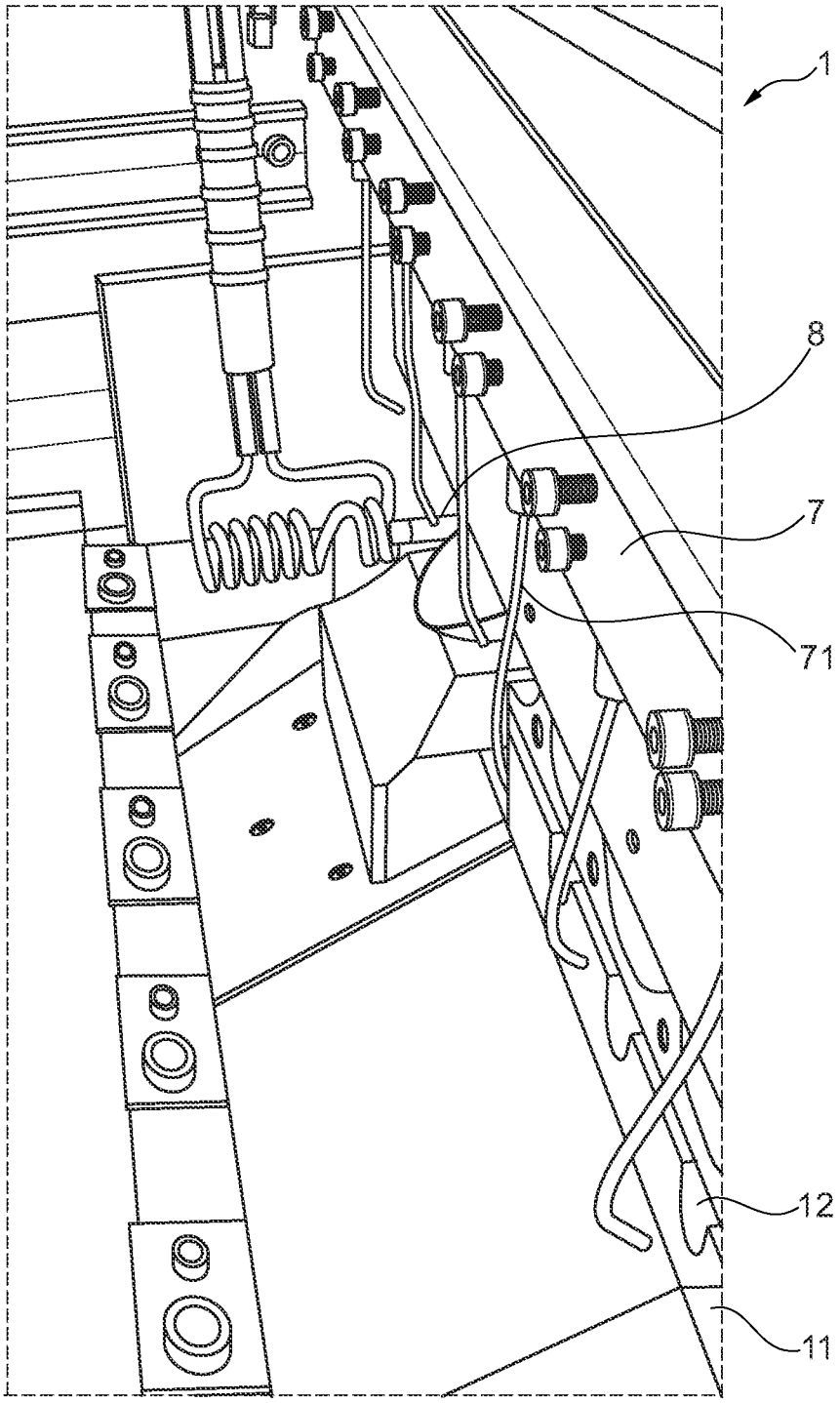
FIG. 1 the schematic partial representation of a multi-stage press, with an induction coil arranged on it, for end-side wire heating.

In FIG. 1, certain sections of a multi-stage press 1 according to the invention are shown. The die block 11 having individual forming stages 12 can be seen; transfer grippers 71 of the transverse transfer device 7 are arranged between the stages. A wire feed is arranged ahead of the first forming stage 12; in the exemplary embodiment, this feed 2 is configured as a servo-drive 21. The wire feed 2 picks up a wire 8 that has been unwound from a coil, not shown. Wire shears 3 that can be controlled separately, for cutting the wire 8 to length, are arranged ahead of the wire feed 2. The transfer grippers 71 of the transfer device 7 are positioned behind the wire shears 3, viewed from the wire feed 2; these grippers are set up for picking up a wire section 81 that has been cut to length by the wire shears 3. An induction coil 4 is arranged, in turn, behind the transfer grippers 71, which coil is positioned in such a manner that a wire picked up by the wire feed 2 can be pushed into the induction coil 4 by way of the servo-drive 21. The wire feed 2, the wire shears 3, and the induction coil 4 are connected with a control and regulation device 6, which in turn is connected with a pyrometer 5 arranged on the induction coil 4 for measuring the temperature of a wire end section 82 that has been introduced into the induction coil 4. Furthermore, the control and regulation device 6 is also connected with the transverse transfer device 7 for controlling the transfer grippers 71. The control and regulation device 6 is part of the overall machine controller, not shown, by way of which control of the punch block, not shown, that carries the individual forming punches also takes place.

Figure 2:
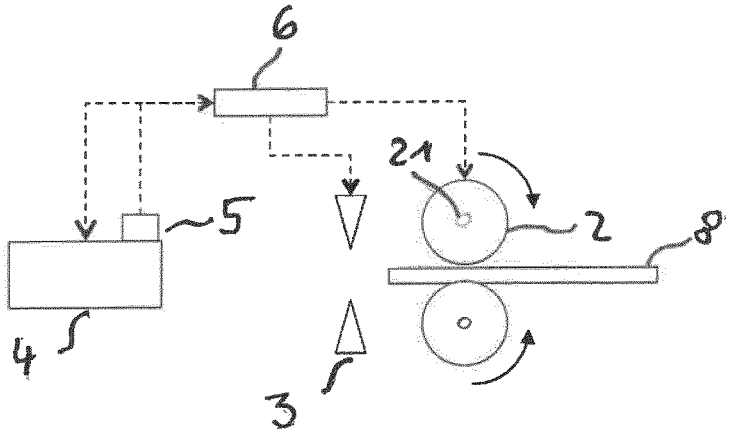
FIG. 2 the schematic representation of the arrangement for wire feed, apparatus for cutting to length, and induction coil, for the production of a wire section heated on the end side, within the multi-stage press from FIG. 1, in the operating states.
Figure 2:
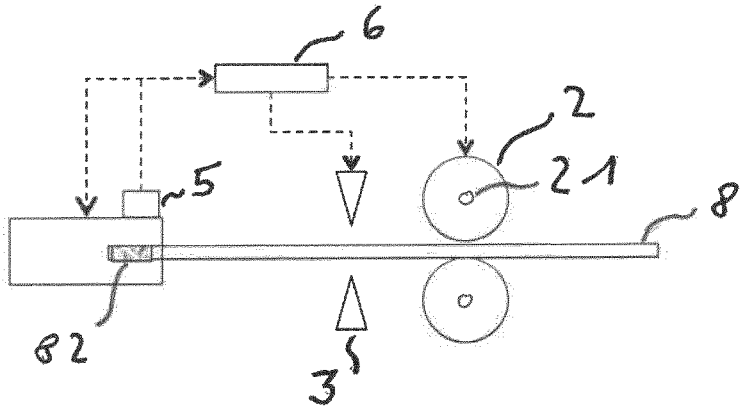
Figure 2:
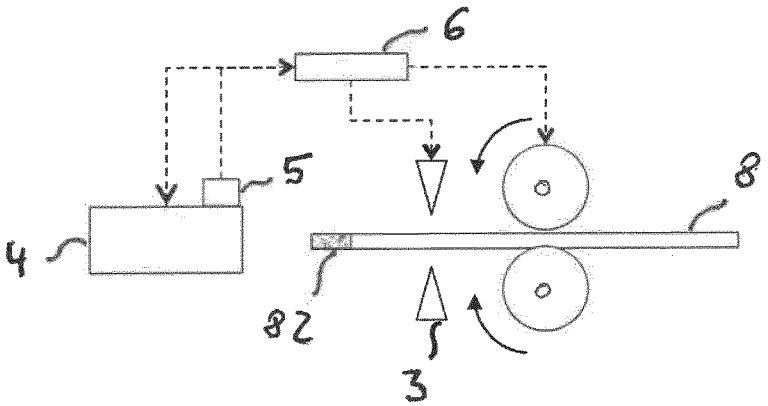
Figure 2:
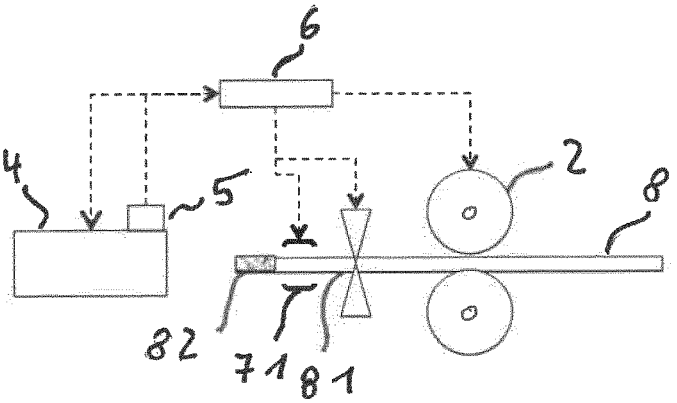

In FIG. 2, the method for production of a screw resistant to high temperatures by means of forming of a wire composed of a nickel-based alloy is outlined. A wire 8 is pushed forward from a coil, not shown, by way of the wire feed 2, through the wire shears, all the way through to the induction coil 4, until an end-side wire end section 82 having a defined length projects into the induction coil 4. For this purpose, the length of the wire end section 82 to be heated as well as the desired temperature are stored in the control and regulation device 6, which also controls the servo-drive 21 of the wire feed 2 (FIG. 2*a*). Afterward, the servo-drive 21 is stopped, so that the wire end section 82 remains in the induction coil 4. The temperature of the wire end section 82 is continuously measured by way of the pyrometer 5. The measured values are reported to the control and regulation device 6, which compares them with the stored reference temperature of the wire end section 82 (FIG. 2*b*).

After the stored reference temperature of the wire end section 82 has been reached, the servo-drive 21 of the wire feed 2 is controlled to move in the opposite direction by way of the control and regulation device 6, so that the wire 8 is pulled back through the wire feed 2, until the wire section that is situated behind the wire shears 3 has reached the length stored in the control and regulation device 6 (FIG. 2*c*). Now the wire shears 3 are activated by way of the control and regulation device 6, and thereby the wire section 81 is cut off at the stored length. The wire section 81 that has been cut to length in this way is gripped by the gripper 71 of the transfer device 7 and transferred to the first forming stage 12 of the die block 11 of the multi-stage press 1. At the same time, renewed advancing of the wire 8 in the direction of the induction coil 4 takes place, until once again the wire end section 82 projects into the induction coil 4 with the desired length. During heating of this next wire end section 82, further forming of the wire section 81 takes place by way of the further forming stages 12. Further forming of the wire section 81, which has been placed into the first forming stage 12 and heated on the end side, by way of the forming stages 12 of the multi-stage press, is known to a person skilled in the art and does not require any further explanation at this point.

At this point, it should be noted that the drive of the punch block, not shown, which holds the individual forming punches, is mechanically uncoupled from the servo-drive of the wire feed 2 as well as from the drive of the transverse transfer device 7. It should furthermore be mentioned that the multi-stage press according to the invention can be used both for conventional production of formed parts by means of a continuous cold-forming method. For this purpose, the wire 8 is directly advanced to such an extent that a wire section 81 having the desired length is arranged behind the wire shears 3, and afterward a wire section 81 is directly cut to length.

The invention claimed is:

1. A multi-stage press for solid forming of a wire section, comprising:

a wire feed with a related apparatus for cutting to length, as well as a transfer device having grippers, for holding of the wire section cut to length and for transfer of the wire section to subsequent forming stages, wherein means for heating of a wire end section of the wire section are arranged on the side of the apparatus for cutting to length that lies opposite the wire feed, wherein the wire feed, the forming stages, and the apparatus for cutting to length can be controlled independently of one another, wherein the means for heating of the wire end section of the wire section are stationary and comprise an induction coil, and wherein the wire feed is set up for temporary introduction of the wire end section of the wire section into the induction coil, and the wire feed comprises a servo-drive configured for defined forward and backward movement of the wire section without movement of the means for heating of the wire end section of the wire section.

2. The multi-stage press according to claim 1, wherein the wire feed can be controlled by way of a controller connected with the wire feed, in which controller a defined dwell time of the wire end section in the induction coil and/or a target temperature can be stored.

3. The multi-stage press according to claim 2, wherein means for detecting the temperature of the wire end section situated in the induction coil are provided, which means are connected with the controller, and wherein a regulator is integrated into the controller, by means of which regulator the wire feed can be controlled as a function of the temperature of the wire end section.

4. The multi-stage press according to claim 2, wherein the controller is connected with the apparatus for cutting to length, and set up in such a manner that after heating at the wire end section of the wire section has taken place, the wire section is cut to a defined length.

5. A method for the production of a formed part using a multi-stage press, wherein a wire is first heated on the end side, wherein the wire is passed from a coil, by way of a wire feed, to a stationary induction coil arranged on the side of an apparatus for cutting the wire to length that lies opposite the wire feed, where the wire is heated to a defined temperature on the end side, on a wire end section, wherein the wire is passed in a forward movement to the stationary induction coil by way of a servo-drive, and wherein the wire is moved into the stationary induction coil in accordance with the desired length of the wire end section to be heated, and after the desired temperature has been reached, the wire is moved out of the stationary induction coil in a backward movement defined by the servo-drive without movement of the stationary induction coil, subsequently a wire section having a desired length is cut at a defined distance from the heated wire end section, and the wire section with the heated wire end section is passed to multiple forming stages, one after the other, by way of a transfer device having grippers for holding the wire section cut to length and for transfer of the wore section to the multiple forming stages.

6. The method according to claim 5, wherein the temperature of the wire end section takes place by way of a contact-free temperature sensor.

7. The method according to claim 5, wherein the dwell time required to reach the desired temperature within the induction coil is determined empirically and stored in a controller connected with the servo-drive.

* * * * *